United States Patent [19]

Wischnack et al.

[11] 4,361,181

[45] Nov. 30, 1982

[54] CASTING CORE AND PROCESS FOR THE PRODUCTION THEREOF

[75] Inventors: Wolfram Wischnack, Vach; Alfred Dobner, Rosstal, both of Fed. Rep. of Germany

[73] Assignee: Alcan Aluminiumwerk Nurnberg GmbH, Frankfurt am Main, Fed. Rep. of Germany

[21] Appl. No.: 339,863

[22] Filed: Jan. 18, 1982

Related U.S. Application Data

[63] Continuation-in-part of Ser. No. 122,039, Feb. 19, 1980, abandoned.

[30] Foreign Application Priority Data

Apr. 27, 1979 [DE] Fed. Rep. of Germany ..... 2917208

[51] Int. Cl.[3] ..... B22C 1/26; B22C 1/02

[52] U.S. Cl. ..... 164/522; 164/525; 164/132; 106/38.5 R

[58] Field of Search ..... 164/525, 529, 522, 523, 164/132, 131; 106/38.5 R

[56] References Cited

U.S. PATENT DOCUMENTS 2,926,098 2/1960 Ilenda et al. ..... 106/38.5 R X

FOREIGN PATENT DOCUMENTS 787804 6/1968 Canada ..... 164/525

152725 2/1963 U.S.S.R. ..... 106/38.5 R

*Primary Examiner*—Gus T. Hampilos

*Assistant Examiner*—K. Y. Lin

*Attorney, Agent, or Firm*—Cooper, Dunham, Clark, Griffin & Moran

[57] ABSTRACT

A casting core for the creation of difficultly accessible cavities in castings of aluminum or of one of its alloys, produced from a water-soluble salt as base substance and burnt sugar as binding agent, and a process for the production of such a casting core wherein the base substance is mixed with burnt sugar in aqueous or organic solution, pressed in molds, and baked at elevated temperature.

4 Claims, 1 Drawing Figure

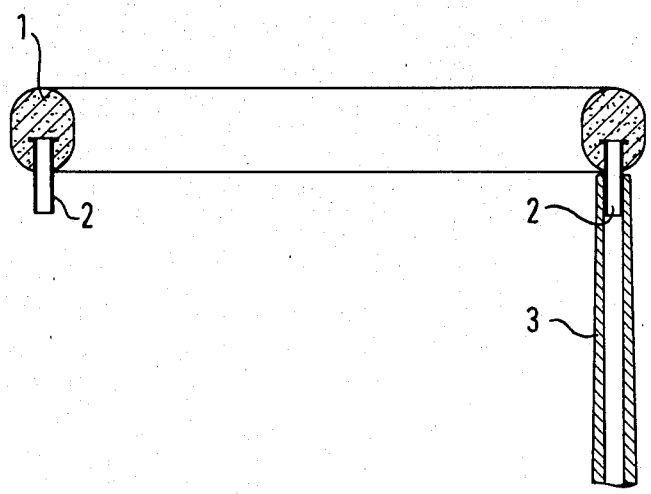
1
2
2
3

CASTING CORE AND PROCESS FOR THE PRODUCTION THEREOF

This application is a continuation-in-part of my earlier application Ser. No. 122,039, filed Feb. 19, 1980, and now abandoned.

BACKGROUND OF THE INVENTION

This invention relates to casting cores, produced from a granular base substance and a sugar derivative as binding agent, for use in creating difficultly accessible cavities in castings of aluminum or of one of its alloys, and to a process for the production of such casting cores.

It is known to provide water-soluble casting cores for the production of complicated or difficultly accessible cavities with narrow cross-sections in metal casting parts. In German patent DE-PS No. 13 02 940, sintered salt cores have been described. According to a further development as described in German Patent DE-PS No. 17 03 004, the water-soluble core material is bonded with a synthetic resin of the urea formaldehyde type, phenol formaldehyde type, melamine formaldehyde type, urea furfuryl type, phenol furfuryl type, or of the sugar- or glucose-based type or respectively compatible compositions of such resins.

Also U.S. Pat. No. 3,645,491 disclosed the use of synthetic resins in combination with water-soluble salt in casting cores.

CA-PS No. 787,804 describes as a casting material a mixture of quartz sand, sodium silicate binder and glucose. This reference proposes the use of glucose together with a mild oxidizing agent not as a binder or binding agent, but as an additive to a sodium silicate binding agent to achieve break-down of the silicate bond, and thereby to enable a mold or core to be readily broken down by vibration after casting. Also DE-AS No. 11 05 565 discloses the use of an acid-treated carbohydrate together with sand for the production of casting cores.

The previously known casting cores, however, are not yet fully satisfactory in their properties, as both the sintered salt cores and those with a resin bond still have disadvantages for many end uses. Thus the production of sintered salt cores is relatively expensive, and for some end uses they are also too brittle. Furthermore, it is relatively difficult to remove them from the casting after the cladding with metal.

Resin-bonded salt cores, on the other hand, have the disadvantages that in their use large quantities of gas may be released from the binder under the action of the casting temperature. To avoid porosity in the casting, these gases must be removed rapidly and completely. Due to the mostly narrow cross-sections resulting from the geometry of the cast parts, obstructions by condensation of resin-type products may easily occur in the outflow passages. This leads to uncontrolled emergence of the gases from the entire core surface, with known adverse consequences for the casting.

SUMMARY OF THE INVENTION

It is therefore an object of the present invention to provide casting cores and a process for the production thereof, from which cores, at the temperatures encountered during the casting of aluminum or its alloys only small quantities of gas, if any, are released, the type of the reaction products being such that removal of gas is possible also through thin passages without condensation products causing obstructions in these passages. A particular object is to enable easy removal of the core material from the cavity of a casting through even very narrow openings, by dissolution of the base substance. It is another object of the present invention to obtain casting cores having a firm structure during the casting process, and which do not suffer from the adverse effect of being too brittle.

In accordance with the invention, these and other objects are attained by the creation of a casting core of the initially mentioned kind which is characterized in that the granular base substance is a water-soluble salt and the binding agent consists of burnt sugar.

As the water-soluble salt any suitable salt may be used. Due to their high solubility it is preferred to use alkali salts as well as suitable salts of the earthalkali metals. A specially preferred salt is sodium chloride.

In the context of the invention, it has been found surprisingly, that by the use of burnt sugar as binding agent, the above-mentioned disadvantages can be avoided. Especially advantageous in this regard is the fact that the casting cores of the invention release (at the casting temperatures) only very small quantities of combustion gases from the binding agent, thereby avoiding the formation of pasty condensation products by which the outflow passages could be constricted or clogged.

Burnt sugar, also called caramel, is usually a composition of more or less dark color which forms when cane sugar, beet sugar or grape sugar—possibly with the addition of a little alkali—is heated to elevated temperatures.

The use of burnt sugar is not comparable to the use of sugars or other sugar derivatives. Burnt sugar consists of a combination of various degradation products. In its composition and reducing capacity it differs from usual sugars and their derivatives. Therefore it cannot be concluded that when a sugar is mixed with a salt, and a casting core is prepared from the mixture with application of heat, similar degradation products will be formed as those contained in burnt sugar.

In specific embodiments of the invention, the base substance consisting of a water-soluble salt, which is being bonded with burnt sugar is present in granular form. As a rule, the granular form facilitates dissolution or removal of the base substance from a casting cavity produced using the core.

It is due to the combination of two highly soluble components that after carrying out the casting procedure the core material can be removed completely even from the most difficultly accessible cavities. Consequently the advantage of the invention—apart from the fact that an adequately firm core structure for casting can be obtained—lies in the high solubility of the two substances from which the casting core is formed.

This is of special interest since the invention serves for casting difficultly accessible cavities, the requirements for such a casting material being different from that of a core material which serves for casting huge volumes.

The proportion of binding agent employed in the core may vary from about 0.3 to 15 weight percent, referred to the total weight of the casting core.

According to a preferred embodiment of the invention, metal tubules are introduced into the cores during the production thereof (e.g. by pressing), in such a way that they can later serve both for the attachment of the cores in the mold and for the removal of the reaction gases during the casting operation. To achieve a secure hold in the core material on the one hand and easy removal of gases on the other, the tubules thus inserted may be flanged in the manner of hollow rivets, or may be laterally slotted or perforated.

For the attachment of the cores in the mold, again tubules, e.g. of metal, may be provided, which are designed so that they offer the possibility of connection to a suction line outside the mold.

Further features and advantages of the invention will be apparent from the detailed description hereinbelow set forth, together with the accompanying drawing.

BRIEF DESCRIPTION OF THE DRAWING

The single FIGURE is a schematic sectional view of a casting core embodying the invention in particular and presently preferred form.

DETAILED DESCRIPTION

In the drawing, the casting core of the invention in its illustrated embodiment is an annular cooling channel core 1, which serves to produce a cooling channel in the piston of an internal combustion engine, i.e. when such a piston is cast from aluminum or an alloy thereof with the core appropriately positioned in the casting mold. The core 1 has molded-in tubules 2 which serve for attachment of the core seatings 3 of a casting mold and also for gas removal.

In the performance of one process according to the invention, the cores are made by mixing the water-soluble salt as base substance with burnt sugar in aqueous, organic, or mixed aqueous-organic solution, pressing it in molds, and baking it at elevated temperature. Although the proportion of solvent used may vary within wide limits, especially favorable results have been obtained with a weight ratio of solvent to organic binder of about 1:1 to 1:10.

For the production of casting cores for specific end uses, it may be preferable or beneficial to maintain the base substance during its coating with the binding agent (i.e. during mixing) at a temperature somewhat increased over room temperature. Thus, for example, the base substance may have a temperature of between 20° and 180° C. during coating with the binder, the mixing operation required for the coating being continued until a dry, pourable mixture has formed.

The subsequent pressing step can also take place at elevated temperatures. Pressing temperatures in the range between 50° and 200° C. are preferred.

The baking, which normally follows the pressing, is also carried out at elevated temperature. Here temperatures between 150° and 300° C. have proven favorable. The time required for the baking lies preferably between about 10 minutes to about 120 minutes.

In the production of the core according to the invention, the drying or removal of solvent by temperature elevation can be accelerated or supported by introducing warm dry air.

The casting cores according to the invention have special advantages. Thus, the cores can be washed out of the finished castings without any effort, e.g. by supplying water. A further advantage of the cores of the invention and also of the method for their production resides in the fact that neither during the production of the cores nor during the casting operation nor during the subsequent washing out of the core residues from the casting are gases, vapors or waste substances formed or released that would be in any way environmentally harmful. Apart from this, as already mentioned above, the quantity of liberated gas is relatively small.

Lastly it should be mentioned that the combination of core materials according to the invention, i.e. a water-soluble salt together with burnt sugar, has excellent decomposition properties, since its binding power is largely destroyed as the casting is being cast. The base substance, which after the casting has cooled is present in largely pourable form, is then easy to remove from the resulting cavity by simple shaking or by rinsing.

The production of the casting core according to the invention is further illustrated in the following example, which is not to be regarded as a restriction:

EXAMPLE

For the production of 100 kg core material, 2.7 kg burnt sugar were diluted with 0.3 kg alcohol and added in this form to a quantity of 97 kg NaCl at a temperature of 120° C. and fed to a gently operating mixer. Already after a short time the salt grains were coated by the binding material and could be dried by introducing warm air. As soon as the mixture was pourable again, it was placed in a die of the desired form and there compacted, the compacting ratio being 1.4:1. The die itself was maintained at a temperature of 140° C. It contained, in an appropriate amount, laterally slotted tubules each having the form of a hollow rivet. The core thus produced, with the tubules fixed therein, was removed from the die with the aid of an appropriate device and subsequently baked for 60 minutes at 220° C. on a support adapted to the form of the core.

Due to the special core composition according to the invention, especially the excellent decomposition properties of the binding agent, the cores can be washed out of the finished casting without any effort. A further advantage of the invention, which could be observed during casting operation, lies in the fact that no harmful gases have been released during the casting or washing operation.

We claim:

1. A casting core for the creation of difficultly accessible cavities in castings of aluminum or of one of its alloys, consisting of a granular base substance and a sugar derivative as binding agent, characterized in that the granular base substance is a water-soluble salt, and the binding agent consists of burnt sugar.

2. A casting core as defined in claim 1, wherein the proportion of binding agent present, referred to the total weight of the core, is 0.3 to 15 percent by weight.

3. A casting core as defined in claim 1, further including at least one tubule pressed into the core.

4. A process for the production of a casting core consisting of a granular base substance which is a water-soluble salt and burnt sugar as binding agent, said process comprising the steps of mixing a water-soluble salt with burnt sugar in solution, pressing the resultant mixture in a mold to form a core body and baking the body at elevated temperature.

* * * * *